US008968021B1

(12) United States Patent
Kennedy et al.

(10) Patent No.: US 8,968,021 B1
(45) Date of Patent: Mar. 3, 2015

(54) SELF-REJECTING AUTOMOTIVE HARNESS CONNECTOR

(71) Applicant: JAE Oregon, Inc., Tualatin, OR (US)

(72) Inventors: Adam Kennedy, Sandy, OR (US); Katsumasa Okuda, Beaverton, OR (US); Guy Letourneau, Warren, OR (US); Kasthuri Sankar Damodharan, Lake Oswego, OR (US)

(73) Assignee: JAE Oregon, Inc., Tualatin, OR (US)

( * ) Notice: Subject to any disclaimer, the term of this patent is extended or adjusted under 35 U.S.C. 154(b) by 0 days.

(21) Appl. No.: 14/335,261

(22) Filed: Jul. 18, 2014

Related U.S. Application Data

(60) Provisional application No. 61/914,829, filed on Dec. 11, 2013.

(51) Int. Cl.

| | |
|---|---|
| ***H01R 13/627*** | (2006.01) |
| ***H01R 13/64*** | (2006.01) |
| ***H01R 43/26*** | (2006.01) |

(52) U.S. Cl.
CPC ..... *H01R 13/64* (2013.01); *H01R 13/6271* (2013.01); *H01R 43/26* (2013.01)
USPC ..... 439/352; 439/489

(58) Field of Classification Search
CPC ..... H01R 13/6272; H01R 13/6275; H01R 13/518; H01R 13/465; H01R 13/641
USPC ..... 439/352–358, 488, 489
See application file for complete search history.

(56) References Cited

U.S. PATENT DOCUMENTS

| | | | |
|---|---|---|---|
| 4,169,650 | A | 10/1979 | Schweizer |
| 5,183,410 | A | 2/1993 | Inaba et al. |
| 5,586,902 | A | 12/1996 | Hopf et al. |
| 5,647,757 | A | 7/1997 | Chrysostomou |
| 5,746,618 | A | 5/1998 | Gauker |
| 5,758,762 | A | 6/1998 | Aulmann |

(Continued)

FOREIGN PATENT DOCUMENTS

| | | | |
|---|---|---|---|
| CA | 2124127 | A1 | 11/1994 |
| CA | 2265177 | A1 | 9/1999 |

(Continued)

OTHER PUBLICATIONS

International Search Report (ISR) and Written Opinion dated Dec. 18, 2014 issued in counterpart International Application No. PCT/US2014/059810.

*Primary Examiner* — Thanh Tam Le
(74) *Attorney, Agent, or Firm* — Holtz, Holtz, Goodman & Chick PC

(57) ABSTRACT

A plug-in connector for connecting to a receptacle including a housing including fins, at least one electrically conductive terminal at least partly situated in the housing and defining a mating axis and a mating direction, cantilevered locking beams arranged in the housing, a slider slidingly coupled to the housing and including blocking beams extending in the mating direction, a compressive member arranged to urge the slider outward away from the housing in the mating direction. The fins are situated to engage with the blocking beams during an initial stage of relative movement between the housing and the slider against a bias of the compressive member and allow inward deflection of the locking beams. The blocking beams are configured to prevent inward deflection of the locking beams after a final stage of the relative movement between the housing and the slider.

30 Claims, 7 Drawing Sheets

(56) References Cited

U.S. PATENT DOCUMENTS

| | | | | |
|---|---|---|---|---|
| 5,848,912 | A | 12/1998 | Okabe | |
| 5,947,763 | A | 9/1999 | Alaksin | |
| 6,019,629 | A | 2/2000 | Ito et al. | |
| 6,024,595 | A | 2/2000 | Saba et al. | |
| 6,089,897 | A | 7/2000 | Boussairy et al. | |
| 6,325,663 | B1 | 12/2001 | Fukuda | |
| 6,435,895 | B1 | 8/2002 | Fink et al. | |
| 6,447,170 | B1 | 9/2002 | Takahashi et al. | |
| 6,468,104 | B2 | 10/2002 | Fukase | |
| 6,494,732 | B2 * | 12/2002 | Kashiyama et al. | 439/352 |
| 6,510,152 | B1 | 1/2003 | Gerszberg et al. | |
| 6,530,799 | B2 | 3/2003 | Regnier et al. | |
| 6,537,098 | B2 * | 3/2003 | Kashiyama et al. | 439/352 |
| 6,561,833 | B2 * | 5/2003 | Saka et al. | 439/352 |
| 6,786,754 | B2 * | 9/2004 | Yamaoka et al. | 439/352 |
| 6,857,892 | B2 | 2/2005 | McLauchlan et al. | |
| 7,059,902 | B2 * | 6/2006 | Nakamura | 439/595 |
| 7,121,888 | B2 | 10/2006 | Brandt et al. | |
| 7,210,940 | B2 | 5/2007 | Baily et al. | |
| 7,238,039 | B2 * | 7/2007 | Holweg | 439/352 |
| 7,326,074 | B1 | 2/2008 | Lim et al. | |
| 7,351,089 | B2 * | 4/2008 | Neale, III | 439/352 |
| 8,616,914 | B2 | 12/2013 | Mumper et al. | |
| 8,766,126 | B2 | 7/2014 | Kawaguchi et al. | |
| 2002/0115338 | A1 | 8/2002 | Nakamura | |
| 2004/0038569 | A1 | 2/2004 | Yamaoka et al. | |
| 2004/0192098 | A1 | 9/2004 | Pavlovic et al. | |
| 2006/0086900 | A1 | 4/2006 | Nakamura | |
| 2007/0254518 | A1 | 11/2007 | Nealle | |
| 2007/0264863 | A1 | 11/2007 | Nakamura | |
| 2009/0035980 | A1 | 2/2009 | Nakamura | |
| 2010/0233897 | A1 | 9/2010 | Seo et al. | |
| 2011/0021060 | A1 | 1/2011 | Urano et al. | |
| 2014/0004732 | A1 | 1/2014 | Heil et al. | |

FOREIGN PATENT DOCUMENTS

| | | | |
|---|---|---|---|
| CA | 2277682 | C | 12/2007 |
| EP | 0828268 | A2 | 3/1998 |
| EP | 1207591 | B1 | 5/2010 |
| JP | 06196039 | A | 7/1994 |
| JP | 09198973 | A | 7/1997 |
| JP | 09306270 | A | 11/1997 |
| JP | 2001015212 | A | 1/2001 |
| JP | 2001338552 | A | 12/2001 |
| JP | 2002063829 | A | 2/2002 |
| JP | 2011108581 | A | 6/2011 |

* cited by examiner

SELF-REJECTING AUTOMOTIVE HARNESS CONNECTOR

CROSS-REFERENCE TO RELATED APPLICATION

This application claims priority under 35 U.S.C. §119(e) of U.S. provisional patent application Ser. No. 61/914,829 filed Dec. 11, 2013, which is incorporated by reference herein.

BACKGROUND OF THE INVENTION

1. Field of the Invention

The present invention relates generally to internal structures and mechanisms of an electronic connector of a cable. More particularly, the present invention relates to internal structures and mechanisms of an electronic controller of a cable used to electronically activate mission-critical safety devices in vehicles.

The present invention also relates to electric connectors for specific cables, namely, those that have a headshell deploying positive locking means to intermate the cable conductors to those in a receptacle on a device or in a receptacle on another cable assembly, with the locking means being substantially permanent or requiring a deliberate actuation of at least one mechanical component of the cable headshell mechanism in order to disengage the cable headshell from the receptacle.

2. Description of the Related Art

Electrical signals and electric power in vehicles are commonly transmitted by electrical cables grouped into a wiring harness. Wires within the harness are grouped into cables which are installed on electrical and electronic devices and modules throughout the vehicle. Electrical interconnection is afforded by cable end headshells containing a plurality of electrical contacts or terminals which intermate with complementary contacts and terminals in receptacles on the devices and modules.

More specifically, there exist connectors that provide for connection of signals and power transmitted through cable harness assemblies which attach to mission-critical safety devices. Since the receptacle is often fixed to structural components of the vehicle relative to the mating motion of the cable harness connector assembly, the connector headshell is considered to plug in to the receptacle and is often referred to as a plug-in connector.

Electrical connectors designed to plug in to mission-critical safety device units require exceptionally high levels of confidence in the efficacy and endurance of good electrical interconnect properties throughout the challenging physical environment of mechanical shocks, vibration, temperature variations, during the foreseeable service life of the vehicle. Additionally for these systems, it is critical to assure correct and reliable installation of the cable to its mating device during the initial assembly of the vehicle and during any repair or maintenance service in which a disconnect and a reconnect of a mission-critical safety device occurs.

Common approaches to assure correct and complete connection of a harness to a mission-critical unit include electrical continuity checks and visual inspection or verification that a cable end headshell is properly engaged with the mission-critical unit. Typical interconnect designs for these applications include snapping detents and physical locking and engaging features which prevent undesirable disconnection. Yet these design features are rarely fool-proof and invite an assembly error in which a partially or incompletely mated connector passes an assessment of its electrical interconnectivity while the physical locking features are not completely engaged and fully actuated.

The danger posed by a positive reading of electrical continuity plus a cursory visual inspection failing to detect that an installment is in fact incomplete is that subsequent vibration, shocks, and atmospheric oxidation in service can disconnect the cable or substantially degrade its electrical interconnect properties such that a mission-critical safety device fails to receive an electrically transmitted signal. One such example would be the explosive squibs used to deploy a passenger airbag failing to operate in a moment of dire need.

Of potential relevance to the invention, U.S. Pat. No. 7,238,039 entitled "Plug-in Connector Comprising a Secondary Locking Mechanism Impinged by a Spring Force" by Holweg, describes a plug-in connector, in particular for airbag retaining systems, that includes a first housing that can be locked in a mating connector by locking arms, and a secondary locking mechanism that can be loaded with a spring force. The secondary locking mechanism has tongues that block the locking arms after they are engaged in the mating connector, as well as detent arms, that are blocked by one edge of the mating connector during the introduction process, until the locking arms are engaged. At this stage, the detent arms are then adapted to slide off the edge wherein, as a result of the spring force that has been previously built up, the secondary locking mechanism is adapted to be moved into its final position.

Mating of the connector may be accomplished in a single motion, and moreover, the connector will provide a self-reject from an incomplete mating, albeit in an inefficient manner relative to the manner in a connector in accordance with the invention provides for a single motion connectivity to a receptacle with a self-reject facet.

Other connector connectivity assurance systems in the prior art of potential relevance generally include electromagnetic actuation or disengagement, rotating or pivoting components, keys, toggles, or rocker actuations, and other elements. Specifically, some latching and locking connectors have latching or locking beams or arms while also having some additional movable component that can reinforce the locked state of the connector by trapping the beam in its engaged state. These secondary or redundant safety features and methods of achieving such a safely redundant locked state are sometimes referred to in the industry as "connector position assurance," and abbreviated as CPA. "CPA" as used in this specification is not to be confused with an abbreviation meaning "Continued Prosecution Application" as described in MPEP 201.06(d).

Besides CPA, the term "terminal position assurance" or "TPA" occurs commonly and describes the art of assuring that conductive terminals resist being pushed out the back end of a housing during a forward mating motion of a connector.

Examples of such connectors include the following:

Canadian Pat. No. CA2124127(A1) entitled "Electric Connector" by Hopf et al., describes a connector with locking beams that engage a standardized annular undercut in the receptacle during a mating motion of the headshell. A second motion is required to manually slide a locking component in a direction defined by the headshell, which second motion happens to be perpendicular to the mating axis defined by the approach of the connector to the receptacle.

Canadian Pat. Appin. No. CA2265177 entitled "Connector With Automatic Insertion and Ejection" by Boussairy et al., describes a device providing a mating action that is assisted or automated by a spring. There is no self-rejecting action during the mating of the device.

Canadian Pat. No. CA2277682(C) entitled "Connector Module" by Miller, et al., describes a connector module that includes a first connector housing, a second connector housing and a connector positive assurance member. Insertion of the first housing into the second housing causes a latching mechanism located within the assembled first and second housings to latch the housings together so that they cannot be readily disengaged. When the first and second housings are fully engaged in this manner, the connector positive assurance member may be moved from a first position to a second position to assure complete engagement has been effected and to lock the housings together. If the first and second housings are not fully engaged, the connector positive assurance member cannot be moved from such first position to such second position.

European Pat. No. EP0828268A2 entitled "Plug-in Snap Acting Mechanism" by Schaar, describes a mechanism that affords electrical disengagement if insufficient actuation force is applied and then released.

European Pat. No. EP1207591B1 entitled "Plug Connector with Secondary Locking Device" by Gunreben, describes a connector including spring arms that insert into an "arm pit" at the root of the locking arms from an opposite axial direction.

Japan Pat. Appl. No. 2000-159569 entitled "Electronic Device" by Mori, describes a pushbutton switch with a spring providing physical resistance to deter actuation, except by a deliberately sufficient force.

Japan Pat. Appl. No. 08-317870 entitled "Electric Switch" by Aulmann, assures a determinate actuation of the switch by forcing the user to operate a second extraneous element before interconnection by the primary means is achieved.

Japan Pat. Appl. No. 08-028549 entitled "Coupling Device For Switch With Operating Device" by Kozono, describes a headshell and engagement means including a drive shaft therein and oriented slits on the receptacle side, so that a primary coupling force is achieved by rotary mechanical advantage rather than a press-on motion.

Japan Pat. Appl. No. 06-196039 entitled "Separating Device Associated With Circuit Breaker" by Paggi, deploys pins (male features) on a headshell and pin-receiving terminals in a plug side.

Japan Pat. Appl. No. 2009-265042 entitled "Operation Switch" by Kawaguchi et al., describes an electric switch with leaf-spring contacts. There is no feature that confirms an efficacious and reliable locked interconnect condition to the user.

Japan Pat. Appl. No. 2005-156211 entitled "Push-Button Switch" by Tetsuya et al., provides for primary and secondary disconnect states, with the final preferred state maintained by the force of a stronger spring overriding that of a smaller, weaker spring.

Japan Pat. Appl. No. 2001-198540 entitled "Push-Lock Switch" by Seki, describes a headshell of a push-button housing that grips the outside of an assembly base, but not an annular recess in a separate receptacle. The movable internal component, called a pusher bar, must clear and subsequently lockingly engage a flange in the assembly base. Release from the locked state of this device is achieved by rotation of the button housing. Release from the locked state cannot be obtained by pulling the button housing away from the receptacle.

Japan Pat. Appl. No. 11-184285 entitled "Locking and Unlocking Mechanism of Cable Connector and Method for Locking and Unlocking" by Takahashi et al., describes a device having two unlocking assistance plates driven by a stirrup in a manual action by the user.

U.S. Pat. No. 5,183,410 entitled "Connector Assembly" by Inaba et al., describes a connector latching mechanism with a limited degree of self-rejection, and cantilever latch features that reside on the receptacle side of the design, and the trip mechanism for the internal sliding component is accomplished with a pivoting action of a rigid part.

U.S. Pat. No. 5,647,757(A) entitled "Electrical Connector With Terminal Position Assurance" by Chrysostomou, describes a connector with a headshell with a CPA member that operates an additional component called a support member by means of a camming motion. Thus, the second movement is distinct from the first mating motion. The connector therefore does not provide a more convenient single motion mechanism with automated triggering of the CPA, or self-rejection.

U.S. Pat. No. 5,746,618 entitled "Squib Connector for Automotive Air Bag Assembly" by Gauker, shows a device lacking a secondary locking action as well as lacking an automatic snap-on means therefor and self-rejecting action.

U.S. Pat. No. 5,848,912(A) entitled "Half-fitting Prevention Connector" by Okabe, describes a connector that includes a self-reject function, but incorporates its latching function into the sliding component. Latching is thus not a first and primary interaction between a housing and its complementary receptacle, with the slider following later so as to disable unlatching of these primary latching means.

U.S. Pat. No. 5,947,763 entitled "Bi-directionally Staged CPA" by Alaksin, describes a connector that requires a pivot motion for disengagement, and has a manually actuated secondary lock to prevent the pivotal motion. The connector does not offer automatic snap-in of the secondary lock and does not offer self-rejection.

U.S. Pat. No. 6,019,629(A) entitled "Connector" by Ito et al., describes a connector having a cantilever latch on a first headshell with a stub which, during mating, retards a spring-loaded slider component held in a complementary second headshell. A ramp of the slider has a predetermined angle such that a threshold of applied mating force, rather than a predetermined partial or complete mate position, trips the slider to move into a locking position. The slider does not have blocking features, but rather has a window to capture the stub on the aforementioned cantilever. This device will self-reject by means of the spring-loaded slider pushing itself off from the mating face of the complementary second headshell. However, no means of disconnection are disclosed, although pulling the pieces apart until something breaks is an obvious method usually directed to applications outside the scope of the invention such as where only a connection is authorized, and the breakage during disconnect is used to evince unauthorized tampering.

U.S. Pat. No. 6,024,595(A) entitled "Connector" by Saba et al., describes a connector that includes a slidable detecting member which is not spring-loaded, but rather is operated by a second motion after an initial mating motion. This device does not offer self-rejection from an incomplete mating attempt.

U.S. Pat. No. 6,325,663(B1) entitled "Half-fitting Prevention Connector" by Fukuda, describes a device with a self-rejection effect by means of a slider which includes a resilient portion integral to it. There is no discrete compression element such as a helical spring, nor a secondary locking or blocking function preventing unwanted disconnection in service.

U.S. Pat. No. 6,435,895(B1) entitled "Connector Position Assurance Device" by Fink et al., describes a complex slider component with its own latches, and assumes a complementary pair of connector headshells for mating immediately proximal yet extraneous to the connector housing. Upon a proper intermate of a pair of these generic connector housings, the component is moved further along the mating direction in a second movement so that its latches lock the headshells together while coming to rest, while ribs on a headshell block an unlatching motion.

There is no automatic spring-driven interlock or self-rejection action.

U.S. Pat. No. 6,468,104(B2) entitled "Connector" by Yoshihiro, describes a headshell of a first connector having a spring-loaded rotatable dowel with a radial stub which rotates the dowel while riding over the ramp face of a wedge located on a second mating connector. The mated pair is locked when the stored spring force rotates the stub behind the rear vertical face of the wedge. This device has no cantilever beam latches and no automatic locking or blocking beams able to prevent disconnect, and no effective mechanism for self-rejecting from an incomplete mating attempt.

U.S. Pat. No. 6,857,892(B2) entitled "Electrical Connector with Connector Position Assurance Member" by McLauchlan et al., describes two complementary connectors for intermating and includes a manually-driven CPA member requiring a second engaging motion separate from a mating motion of the connectors. The CPA component interferes with unlatching motion of a locked latch but this blocking feature of the CPA is a singular portion centrally located on the CPA.

U.S. Pat. No. 7,326,074(B1) entitled "Connector Position Assurance Device and a Connector Assembly Incorporating the Connector Position Assurance Device" by Lim et al., describes a connector that includes a cable headshell latchable to a complementary in-line cable connector housing by means of a larger primary latch. The headshell includes a movable component with its own pair of smaller secondary latches. The movable member is slid into latching engagement of its secondary latches to the connector housing and blocks the primary latch from unlatching. The secondary component requires a second movement by the user rather than an automatic stage and release action of an internal slider. Furthermore, the connector does not provide a mechanism for either visual indication of, or self-rejection from an incomplete mating.

U.S. Pat. No. 8,616,914 entitled "Checkable Plug-in Connection and Method for Checking the Connection State of a Plug-in Connection" by Mumper, describes a connector that includes a movable "verification element" on the headshell which becomes visibly displaced after a complete and locked mating attempt and this element functions as a tool to enable disconnection. The verification element can be removed by the installer to prevent unauthorized tampering with a confirmed correct mating condition, because the latching means can only be disabled by re-insertion of the verification element. There is no disclosure of providing for an automatic self-rejection from an incomplete mating.

U.S. Pat. Appin. Publ. No. 2002/0115338(A1) entitled "Connector and Method of Assembling a Connector" by Nakamura, describes a connector that offers self-rejection but does not include an automatically engaging secondary lock, or any blocking means in the secondary lock that are able to prevent disengagement of the primary lock.

U.S. Pat. Appin. Publ. No. 2009/0035980(A1) entitled "Connector and Connector Assembly" by Nakamura, describes a connector housing pierced with an inspection window and another component of a distinct color which indicates a complete mating attempt by moving into a visually verifiable zone in the window.

U.S. Pat. Appin. Publ. No. 2010/0233897(A1) entitled "Electrical Connector Assembly Having Connector Position Assurance Device" by Seo et al., describes a device having a manually actuated secondary lock, but does not offer automatic snap-in of the secondary lock or self-rejection.

U.S. Pat. Appin. Publ. No. 2011/0021060 entitled "Connector" by Urano et al., describes a connector with a manually actuated secondary lock. The connector does not offer automatic snap-in of the secondary lock or self-rejection.

U.S. Pat. Appin. Publ. No. 2004/0038569(A1) entitled "Connector and a Connector Assembly" by Yamaoka et al., describes a connector that provides for something similar to a spring-loaded self-rejection but, rather than including a tripping mechanism to release stored compressed force accumulated during the approach of the connectors being mated, the rejection force remains accumulated while a secondary redundant lock is established by an additional manual movement of a yet additional sliding component.

U.S. Pat. Appin. Publ. No. 2004/0192098 entitled "Electrical Connector With Spring/Back Self Rejection Feature" by Pavlovic et al., describes a connector that offers self-rejection from an incomplete mate, but does so by contacting the "abutment" surface of a receptacle directly with its resilient member. As the headshell continues in the mating direction, a rejection force is accumulated in the resilient member until, by means of a detent feature in this member, the rejection force is suddenly substantially reduced or redirected upon itself rather than against the receptacle. The connector does not provide a secondary locking of previously engaged latches.

U.S. Pat. Appin. Publ. No. 2006/0086900(A1) entitled "Connector" by Nakamura, describes a connector that includes components similar to the connectors of Lim et al. and Hopf et al. The connector assembly includes a cable headshell including a movable detecting member initially standing proud of the contour of the headshell, which detects an incomplete mating attempt by remaining blocked from allowing itself to be pushed down flush with the headshell contour until a complete mating attempt is made between the headshell and a complementary receiving receptacle. Similar to the Hopf et al. connector, an additional component slidably coupled to the headshell can slide over and cover the detecting member in a second motion perpendicular to and less convenient than the initial mating direction. Also like the Hopf et al. connector, the secondary component requires a second movement by the user, rather than an automatic stage and release action of an internal slider. Furthermore, the connector of Nakamura does not provide a mechanism for either visual indication of, or self-rejection from an incomplete mating attempt.

U.S. Pat. Appin. Publ. No. 2007/0254518(A1) entitled "Electrical Connector Having a CPA Plug" by Nealle, describes a connector that has a sliding CPA member substantially enclosed within a two-part connector housing, but lacks a spring or other compressive member to store and release compressive force to effect the automatic, snap-on locking action. Furthermore, the Nealle connector appears to employ flexural bending of both locking and blocking features. No helical spring, resilient member, or other driving mechanism is disclosed.

U.S. Pat. Appin. Publ. No. 2007/0264863(A1) entitled "Connector and a Connector Assembly" by Nakamura, describes a connector that includes latches on a slider and fins on latch cantilever beams, but does not include a spring-loaded slider and offers no self-rejection action.

U.S. Pat. Appin. Publ. No. 2014/0004732(A1) entitled "Connector Position Assurance Device for a Connector Assembly" by Heil et al., describes a connector that has a manually driven secondary lock operable by a second motion after a mating motion of two connector housings. This secondary lock is neither spring-loaded nor tripped at a predetermined point at which a confirmed complete mating attempt has been established.

SUMMARY OF THE INVENTION

A connector assembly in accordance with the invention includes means for mechanically storing applied insertion force so that in the event of an incomplete mating attempt in which the locking means between the connector and the receptacle do not positively and completely deploy, then the stored force is utilized so as to self-reject, that is, to autochthonously displace and separate the headshell from the receptacle so that failure to completely mate the connectors results in electrical disconnection detectable as a discontinuity during a continuity check, and also the autochthonous displacement is sufficiently egregious that it is visually apparent that proper installation has failed to occur. That is, a housing of the connector includes components that result in two visually distinct positions, namely, a displaced position in which the connector lacks any connection to the receptacle and a mated position in which the connector is unquestionably electrically connected to the receptacle. There is no intermediate position for the connector, i.e., either it has a disconnected position apart from the receptacle or a connected position in electrical engagement with the receptacle, both of which can easily be observed by the person attempting to connect the connector to the receptacle.

A connector assembly in accordance with the invention accomplishes CPA by using an internal component referred to as a slider which is driven by a compressive member, such as a helical spring, so the slider will release at a predetermined fully mated engagement. So released, the slider is then driven automatically to insert a blocking beam directly behind a previously engaged latching beam, so that the operative space needed for unlatch is blocked. The latch is now trapped in its locked state and the cable-side connector cannot disengage from its complementary plug-side receptacle. The connector assembly is advantageous, in one respect, over prior art connectors in view of this secondary locking element reinforcing these cantilever features against becoming unlatched, and specifically, advantageous over prior art latching connectors lacking cantilevered means of locking into complementary features.

Also, by virtue of the automatic cock and release mating action, a connector in accordance with the invention differs from prior art devices which include a secondary locking component driven by a second manual motion of the user, devices where the secondary lock component is substantially external to a connector headshell, and devices using an extraneous component such as a safety clip, "keeper," trapped hardware, or any supplemental motion to engage a component.

Since the connector is designed to allow a number of mates and unmates (mating releases) during a certain service life, it also differs from latching connectors that are designed to resist or evince unauthorized disconnection by not allowing an unlatch unless some component is forcibly broken (i.e., it is a multiple use connector as opposed to a single use connector). Tangentially, many medical connectors for devices designed for insertion into a human patient are designed to break something when disconnected so as to prevent a previously used device from being reconnected and used again in another human body. A more proximate reason to deny disconnection comes in the trafficking of used auto parts. While used vehicles and larger subassemblies, such as a steering column assembly including a factory-charged airbag, may be traded with little regulatory oversight, a person dissecting the gas-generating device may knowingly or unknowingly encounter the full brunt of 27 CFR 55 governing the possession, storage, and transportation of explosives, including the regulation and licensing of such persons. These special self-destructive, tamper-evident, and single-use disposable connector schemes are thus also different from the invention.

A connector in accordance with the invention also differs from devices that cock a spring during electrical engagement, remain engaged during a service interval, and thereafter release stored spring force to electrically disconnect, such as in overload circuit breakers or timed delay devices. The structure of the inventive connector also differs from mechanisms having opposing springs or multiple springs for motions in a staged sequence rather than acting uniformly and in concert, and differs from over-center, slider-crank, classical 3- and 4-bar linkages, cams and cam-followers, levers and fulcra, all threaded couplings, and also any detenting mechanisms. The structure of the inventive connector also differs from mechanisms including a housing and also a contact or terminal carrier which moves electrical contacts at a rate or in a motion different from the motion of the housing. The inventive connector also differs from connectors making or breaking an electrical short between conductors as a means of electrically signaling a complete mate. Although somewhat similar to connectors including a sliding member that deploys blocking members to prevent a primary latch from disengaging, but which include an integral compressive component rather than being driven by a discrete component, the inventive connector is still different in other respects than such connectors as can be gleaned from the description of the connector.

A connector in accordance with the invention also advantageously satisfies a requirement of an auto industry specification currently in force by providing both a tactile signal and an audible click when a correct and reliable interconnection has been achieved.

Another important advantage of an embodiment of a connector in accordance with the invention is that all mechanical actions happen during a single, linear mating action accomplished by press inserting an aligned and registered connector headshell assembly into a complementary receiving receptacle until it is snappingly received into a locked mated state which becomes blocked from becoming unlocked by means of an entirely automatic operation. This single action in a single direction therefore differs from prior art connectors that require two separate actions, in different, sometimes perpendicular directions, in order to provide for a complete mating of a connector to a receptacle.

The connector assembly is primarily designed for an airbag supplemental restraint system, but its use is in no way limited to such a system, and numerous other and diverse uses are contemplated as being within the scope of the invention.

BRIEF DESCRIPTION OF THE DRAWINGS

The present invention will be more fully understood from the following detailed description of embodiments thereof, taken together with the drawings, in which.

DETAILED DESCRIPTION OF PREFERRED EMBODIMENTS

Figure 1:
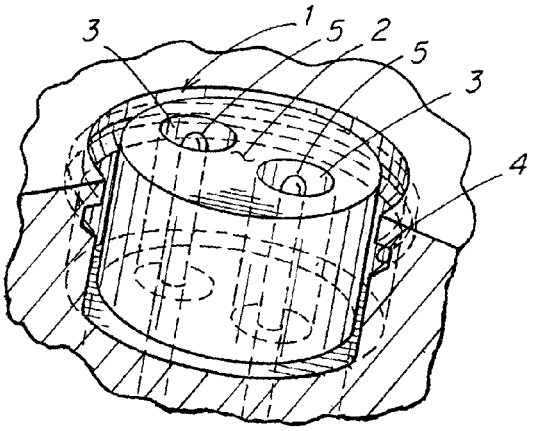
FIG. 1 shows an example of a receptacle to which the connector assembly in accordance with the invention can be mated.

Referring to the accompanying drawings wherein the same reference numbers refer to the same or similar elements, FIG. 1 shows a broken-view partial cross section of a typical, generally circular receptacle as an example of a receptacle to which the inventive connector assembly is designed to mate in a highly dependable and reliable manner. This receptacle is also referred to as a "plug connector" herein and the inventive connector assembly is also referred to as a "receptacle connector" herein. Certain features of the receptacle are controlled by industry standards and are outside the scope of this invention. Generally, the receptacle offers a substantially annular cavity 1, an outward facing bulkhead surface 2 of a cylindrical form inside the cavity 1 and that is generally perpendicular to the direction of line of action of the mating motion of the connector assembly to the receptacle, and a plurality of terminal-containing apertures 3 within which reside a set of electrical conductive terminals or terminal pins 5.

The apertures 3 in the cylindrical form are defined by a substantially cylindrical surface distant from the edge of the cylindrical form that defines the inner surface of the cavity 1, and the terminals 5 may also be substantially cylindrical as shown in FIG. 1, to thereby define an annular space between each of the apertures 3 and the respective one of the terminals 5 therein. The terminals 5 are electrically connected to an electronic component to be electrically connected to the connector assembly, in a manner known to those skilled in the art to which this invention pertains.

In one embodiment, the number of terminals 5 and the number of contacts and signal lines to be electrically intermated by means of the connector assembly in accordance with the invention is two.

The annular cavity 1 includes a latch-receiving undercut 4 which may exist as an internal groove following the perimeter of the cavity 1, as in one embodiment, or may be interrupted so as to offer a set of intermittent latch-receiving apertures or pockets extending transverse to the line of action of the mating motion. In either case, a plurality of undercut sites are formed, the purpose of which is described below. The undercut 4 is formed in the surface defining the outer cylindrical surface of the annular cavity 1.

The bulkhead surface 2 may be integral to a receptacle body but is more commonly a permanently installed special insert with physical coding and keying structure designed to accept or reject complementary physical structure integral to the inventive connector assembly, but the specificities of these coding and polarity-enforcing structures are outside the scope of this invention and these keying structures are not illustrated here. Additionally, applications may offer groups of receptacles in close proximity which must be correctly connected to by a plurality of designated headshells, and to eliminate confusion and aid correct assembly, the key-coding of headshells and receptacles which reject mis-wiring is augmented by color-coded molding of plastic parts so that a user having selected one of among several diversely colored headshells can rapidly locate the proper receptacle having an insert of the same color-code, and proceed with correct installation.

Figure 2:
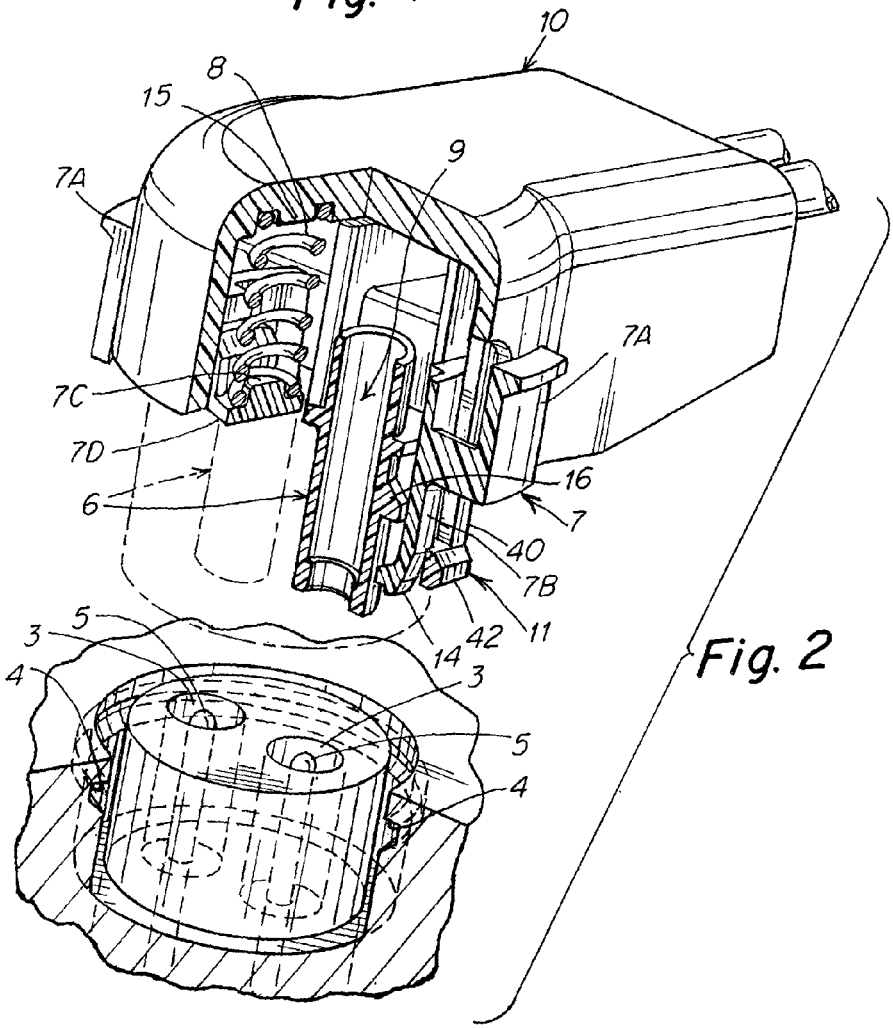
FIG. 2 shows an example of an initial approach of the connector assembly in accordance with the invention when being mated to the receptacle shown in FIG. 1.

FIG. 2 shows a similar broken-view partial cross section of the receptacle of FIG. 1 in proximity to a connector assembly in accordance with the invention which is designated generally as 10. Connector assembly 10 is also referred to as a headshell assembly and includes a plurality of tubular protuberances 6 extending from a lower surface of the headshell assembly (in the configuration shown in FIG. 2) and that thus have a hollow interior. The protuberances 6 are generally parallel to one another, and their parallel axes define a mating direction.

The headshell assembly 10 also includes a plurality of cantilevered locking beams 11 which latchingly engage into the latch-receiving undercut 4 in the receptacle (see FIG. 1). Locking beams 11 are also considered and/or referred to as latching members herein. Female electrical terminals (not shown in FIG. 2) are disposed within the protuberances 6 in the vicinity indicated by reference number 9 so as to electrically contact to the receptacle pins 5 when the headshell assembly 10 is mated with the receptacle.

The design of the female electrical terminals is outside the scope of this invention and they are thus omitted in FIG. 2. However, an example of a female electrical terminal is female contact 12 shown in FIG. 3, described below. Also omitted are electric wires leading into the headshell assembly 10 which are connected to the female electrical terminals. Female electrical terminals may have, however, a variety of different configurations known to those skilled in the art.

Although the illustrated embodiment includes two protuberances 6 each including a female electrical terminal 12, it is possible to construct the headshell assembly 10 with only a single protuberance 6 and a single female electrical terminal (described below with reference to FIGS. 12-14), or more than two protuberances and a corresponding number of female electrical terminals 12.

Headshell assembly 10 also includes a slider 7, which in one embodiment, offers two ears 7A disposed in biradial symmetry and closely fitted to the perimeter of the main body of headshell assembly 10. The slider 7 is slidingly coupled within the headshell assembly 10 by means of a compressive member 8 lightly pre-loaded in compression. In one embodiment, the compressive member 8 is a helical spring, although other comparable structures that enable a force to be exerted on the slider 7 to force it away from the body of the headshell assembly 10 are also within the scope of the invention. Hereinafter, the compressive member 8 may be referred to as a spring.

Figure 3:
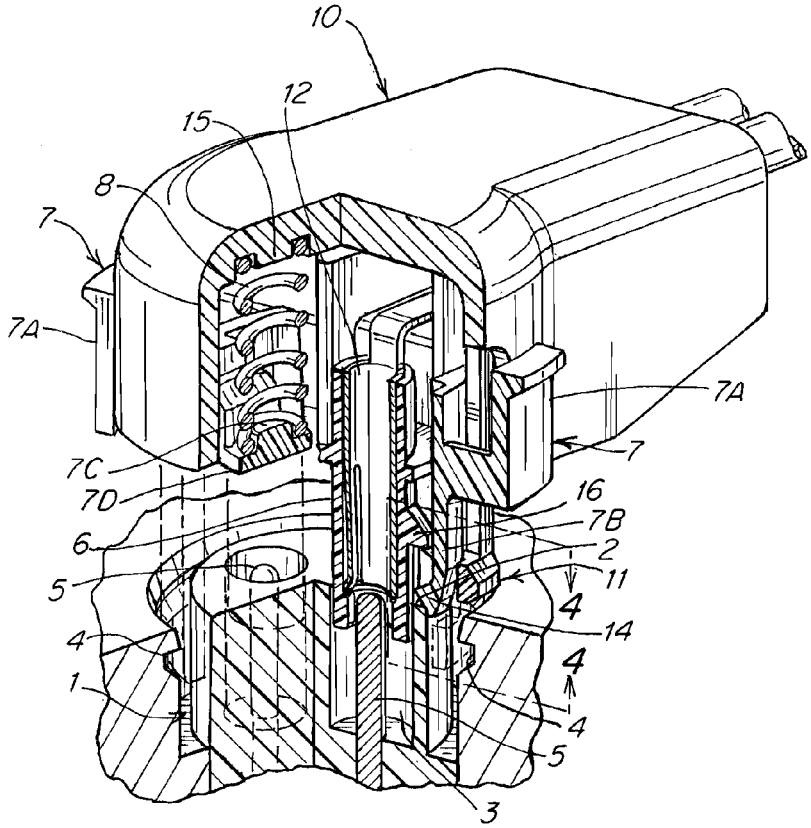
FIG. 3 shows a connector housing at a first intermediate mating condition.

At rest, the compressive member 8 is disposed between the slider 7 and an upper support wall of the headshell assembly 10 and forces the slider 7 to a fully extended position in the mating direction. At one end, the spring 8 may rest on a spring support portion 7C of the slider 7 that typically defines a projection around which the spring 8 is retained (as shown in FIGS. 2 and 3). The spring support portion 7C is situated in a bridging portion 7D of the slider 7 that bridges the ears 7A (best seen in FIG. 8). Bridging portion 7D presents a solid floor that is preferably reinforced at an area where the spring support portion 7C is formed to enable it to withstand numerous spring-driven impacts. In use, a noise is created by this impact, and would readily be associated by the user with the slider 7 achieving its final position. In this manner, an industry specification called "USCAR-2" that requires both a tactile signal, such as a detent, and an audible noise, such as a click, would be satisfied when the slider 7 reaches its final stage at which electrical connection provided by the headshell assembly 10 is achieved.

At an opposite end, the spring 8 rests on a projection 15 formed on the inner surface of the headshell assembly 10, specifically a cover 20 thereof. This obviously prevents the spring 8 from being ejected from the headshell assembly 10 during use. Other spring retaining structure may also be used in accordance with the invention.

The slider 7 also includes a plurality of blocking beams 7B which extend in the mating direction and which interfere with cantilevered locking beams 11 of the headshell assembly 10 so that with the slider 7 in its extended position, the flexural compliance of the locking beams 11 is denied. That is, the locking beams 11 cannot engage with the latch-receiving undercut 4 locking sites of the receptacle unless the slider 7 has been moved from the extended position.

More specifically, the structure of the slider 7 includes the ears 7A that each includes a portion extending radially outward and also a portion extending parallel to the mating axis of the connector headshell assembly 10. The radial outwardly extending portion of each ear 7A passes through an interior wall of the body of the headshell assembly 10 such that a portion of the slider 7 is inside the body and a portion of the slider 7 is outside of the body and manually accessible, i.e., the portion of each ear 7A extending parallel to the mating axis of the connector headshell assembly 10 (see FIGS. 2 and 3). The slider is thus movable by grasping the outside portion of the ears 7A.

The slider 7 also includes the blocking beams 7B that extend in the mating direction above and below the area at which the radially extending portion of the ears 7A project (see FIGS. 3 and 4). A styloid 14, described more fully below, is formed at the lower edge of each blocking beam 7B.

FIG. 3 enables a more detailed explanation of the operation of the slider 7 by depicting the headshell assembly 10 in a first intermediate position which is a partial, incomplete engagement with the receptacle. FIG. 3 also shows the receptacle pin 5 in cross-section. A relevant portion of a female contact 12 retained within the main body of headshell assembly 10, as an example of a female electrical terminal described above, offers at least one contact point 13 near the tip of an electrically conductive contact beam or contact blade.

Before proceeding further, it must be appreciated that although the following detailed description of the sequence of operations concentrates on one set of interrelated members at one latching site, a connector assembly in accordance with the invention incorporates a plurality of mating operations at a plurality of sites simultaneously. For example, in one embodiment, latching and locking described below is effected at two substantially diametrically opposed sites within a circular receptacle.

Figure 4:
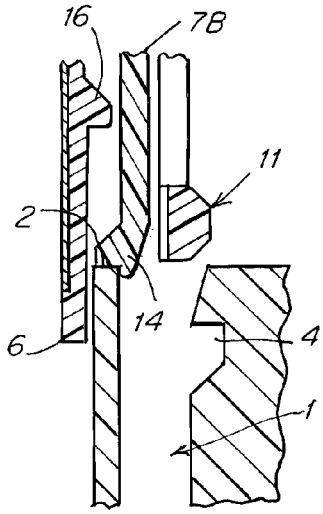
FIG. 4 is an enlarged view of the area enclosed by arrows 4-4 in FIG. 3.

In a first intermediate position, although the contact 12 has not yet touched the receptacle pin 5, the styloid 14 inherent in the blocking beam 7B of the slider 7 is now in contact with the bulkhead surface 2 by its end face, which end face is also perpendicular to the mating direction (see FIGS. 3 and 4). In this intermediate position, the spring 8 has become more compressed since the headshell assembly 10 has been urged toward the receptacle from the position shown in FIG. 2 to the position shown in FIG. 3. Therefore, if the mating force applied to the body of the headshell assembly 10 were removed, the compression in the spring 8 would pass through the slider 7 and present against the bulkhead surface 2 of the receptacle, opposing the initial mating motion. Left alone, the connector assembly 10 would fall away from the receptacle or at least remain in a position obviously distant from a successful, fully mated installation.

Figure 5:
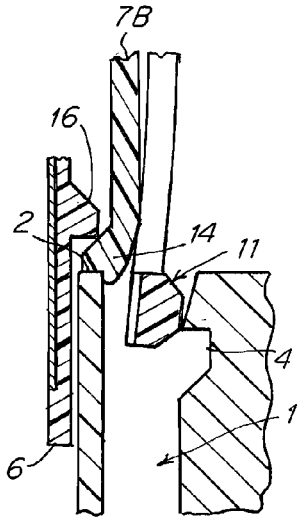
FIG. 5 shows connector locking components and the receptacle in a second intermediate mating condition.

FIG. 5 shows detailed interactions of critical features of the slider 7 and the headshell assembly 10 at a second intermediate position closer to the final and complete engagement of the inventive connector system, in the same cross sectional view as FIG. 4. In this detailed view of the receptacle, a fin 16 in the body of the headshell assembly 10 abuts a backside ramp of the styloid 14 of the blocking beam 7B of the slider 7. Fin 16 is formed on an outer peripheral surface of the protuberance 6. One or more fins 16 may be formed on each of the protuberances 6. Also, the lower surface of the styloid 14, when viewed as shown in FIGS. 4 and 5, includes a step that receives the edge of the bulkhead surface 2.

Figure 6:
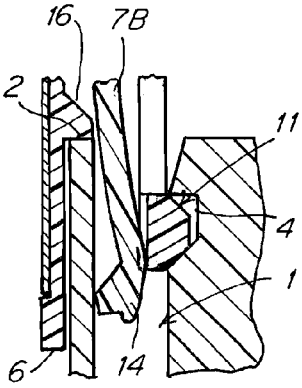
FIG. 6 shows connector locking components and receptacle in a final mated and locked condition.

The styloid 14 may include an inclined upper surface that is designed to contact the fin 16 during intermediate movement of the connector assembly 10 into the receptacle, i.e., the backside ramp (see FIG. 5), and then in view of further movement of the connector assembly 10 into the receptacle, the fin 16 slides along the inclined surface and urges the styloid 14 and blocking beam 7B in its entirety outward to pass over the bulkhead 2 (into the position shown in FIG. 6). During this latter stage, the locking beams 11 pass into the respective undercut site of the undercut 4 on the receptacle (to the position shown in FIG. 6).

Furthermore, the cantilevered locking beam 11 of the body of the headshell assembly 10 is deflected as it approaches, but is not yet latchingly engaged, that is, locked, into the latch-receiving undercut 4 of the receptacle. It is possible, but not necessary, that electrical continuity will have developed between the receptacle pins 5 and the connector terminals 12. In this position, the spring 8 is even more compressed and retains sufficient force that if mating force is removed at this second intermediate position as well, the spring force will present through the styloid 14 of the blocking beam 7B as it abuts the bulkhead surface 2 of the receptacle, and disengage the connector assembly 10 from the receptacle (as described in the first intermediate position of FIGS. 3 and 4. Additionally, any electrical continuity present at this second intermediate position will be terminated by physical disconnection.

Continued insertion of the connector assembly 10 into the receptacle will cause the fin 16 to force the styloid 14 into a displaced state wherein it will evade and fall clear of the rim of the bulkhead surface 2 (see FIG. 6). A fully mated and locked condition is thereby established wherein the slider 7 has lunged further down the receptacle cavity under the force of the spring 8 between the slider 7 and the headshell assembly 10 having been allowed to extend, thereby dissipating its disengagement force. Furthermore, the cantilever locking beam 11 of the body of the headshell assembly 10 is fully engaged within the latch-receiving undercut 4 of the receptacle, and the extended position of the slider 7, having been driven by the spring 8, moves the blocking beam into an interfering position which advantageously prevents the cantilever locking beam 11 from extricating itself from the latch-receiving undercut 4 of the receptacle.

Therefore, in the absence of extreme forces beyond the range of reasonable robustness expected for this connector system, the fully mated and locked condition of the connector will endure. However, in the event that disconnection is desired, a process reversing these elements is followed: by gripping only the ears 7A of the slider 7 and pulling the entire connector assembly away from the receptacle, the spring 8 between the slider 7 and the body of the connector assembly headshell 10 is compressed. The ears 7A of the slider 7 are manually accessible as they are outside of the body (see FIGS. 2 and 3). Then styloid 14 is pulled clear from the cantilever locking beam 11, which can then escape from and disengage from the latch-receiving undercut 4 of the receptacle. Upon such disengagement, the headshell assembly 10 simply pulls free of the receptacle.

Figure 7:
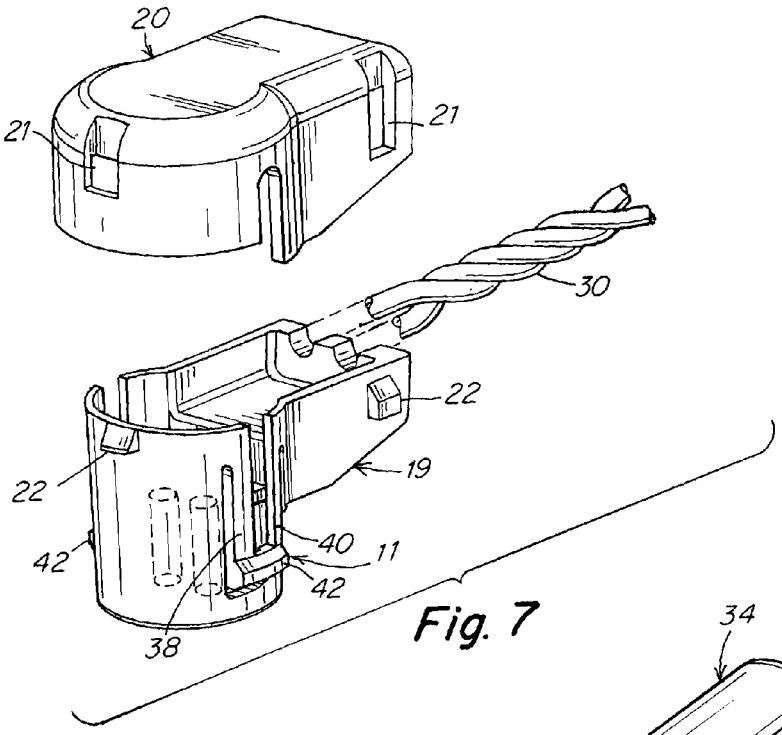
FIG. 7 shows a right-angle embodiment of a connector in accordance with the invention depicting right-angle orientation of the mating direction as defined by the terminals, and also depicting a unitary headshell constructed from a housing and a cover.

FIG. 7 illustrates a right-angle connector design within the scope of the invention. The slider, compressive member, and pin-receiving terminals are omitted for clarity and so as to concentrate on an enclosure housing constructed from a plurality of pieces. Signal carrying cables or wires 30 are illustrated in conjunction with phantom line indication of the orientation of the pin-receiving terminals of a right-angle connector headshell. The headshell is an integral assembly of a housing 19 and a cover 20, wherein the housing 19 includes a plurality of stubs 22 for latching engagement within lumina 21 of the cover 20 by means of mechanical compliance of the cover 20 during a snap-together assembly. Therefore, a substantially rigid and unitary headshell containing the terminals and admitting the signal carrying wires 30 which lead to the terminals is constructed from the housing 19 and cover 20.

Other mechanisms for connecting the housing 19 to the cover are also within the scope of the invention, and such mechanisms will be referred to as connecting means herein. Connecting means thus encompass stubs and lumina, other two-part connecting mechanisms with one part on the housing and the other part on the cover, and any other connectors used to connect a pair of components of a connector together that are known to those skilled in the art to which the invention pertains.

In addition, it is not necessary to provide a plurality of stubs 22 and complementary lumina 21, but rather only a single stub and lumen may be provided.

FIG. 7 also shows that the locking beam 11 includes two spaced apart cantilever sections 38, 40 bridged at their tips by a unitary latching feature 42. The same structure is present on the opposite side of the housing 19. One of the blocking beams 7B is arranged to operate in between each pair of cantilever sections 38, 40 of the locking beam 11.

Figure 8:
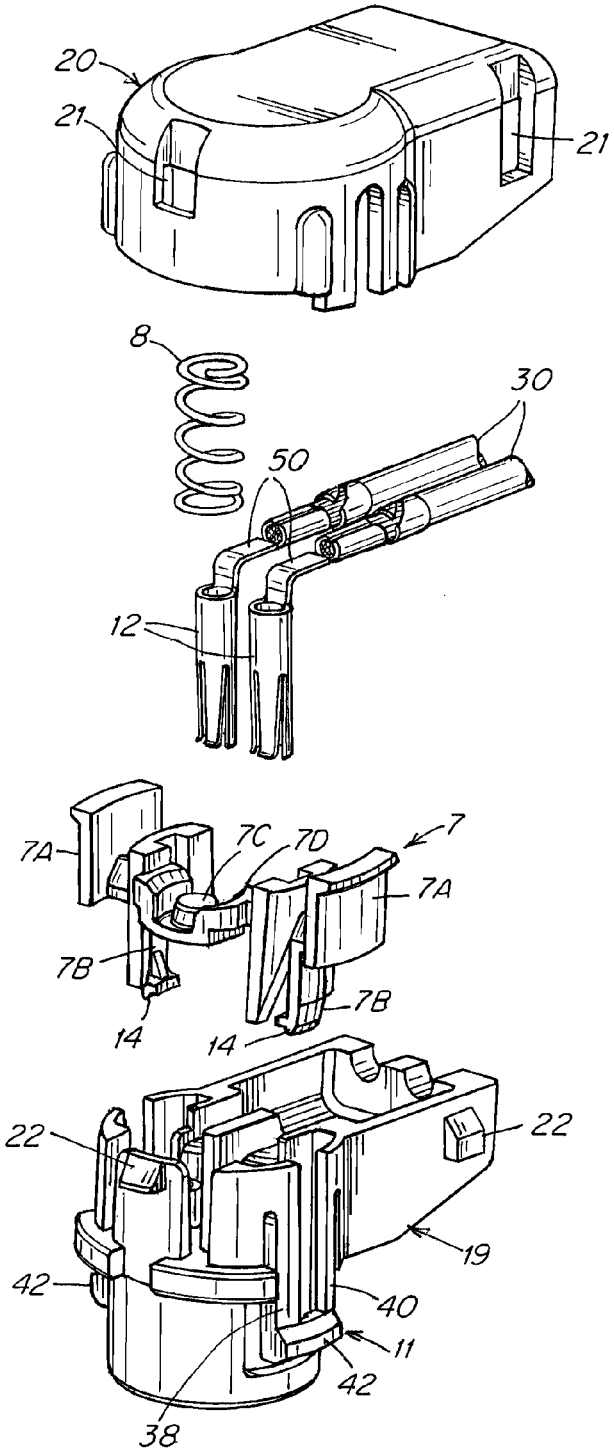
FIG. 8 is an exploded view of the embodiment of the connector shown in FIG. 7 including all of the components.

FIG. 8 is an exploded view of the right-angle connector design shown in FIG. 7 including all of the components. Each female contact 12, of which there are two in this embodiment, is shown as part of a connector terminal 50 that mates with a respective one of the signal carrying wires 30.

Figure 9:
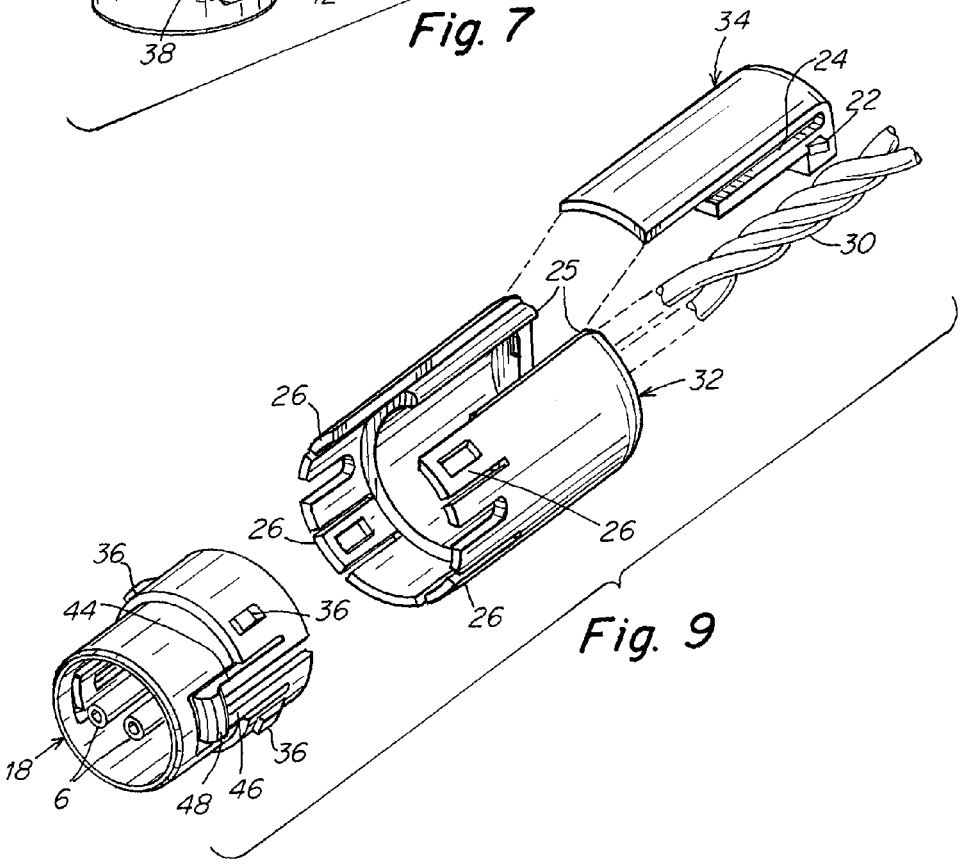
FIG. 9 shows an embodiment of an axial headshell housing assembly in accordance with the invention.

FIG. 9 shows an axial or straight connector in which the headshell assembly is constructed from a housing 18 and a plurality of cover components which in this embodiment are a first cover 32 and a second cover 34. The first cover 32 includes a plurality of latches 26 which snappingly engage onto a complementary set of stubs 36 on the housing 18. The second cover 34 includes alignment grooves 24 which register with alignment strakes 25 on the first cover 32. The stubs 36 on the second cover 34 snappingly engage with the internal surfaces of first cover 32 by means of mechanical compliance of the first cover 32 while the second cover 34 is being slidingly assembled onto it.

Other mechanisms for connecting the housing 18 to the cover 32 and the cover 32 to the cover 34 are also within the scope of the invention, and such mechanisms will be referred to as connecting means herein. Connecting means thus encompass stubs and latches, grooves and strakes, other two-part connecting mechanisms with one part on the housing (or first cover) and the other part on the first cover (or second cover), and any other connectors used to connect a pair of components of a connector together that are known to those skilled in the art to which the invention pertains.

In addition, it is not necessary to provide a plurality of latches 26 and complementary stubs 36, but rather only a single latch 26 and stub 36 may be provided. Also, it is not necessary to provide a plurality of grooves 24 and alignment strakes 25, but rather only a single groove 24 and alignment strake 25 may be provided.

FIG. 9 also shows a feature to that shown in FIG. 7, i.e., the locking beam 11 includes two spaced apart cantilever sections 44, 46 bridged at their tips by a unitary latching feature 48. The same structure is present on the opposite side of the housing 18. One of the blocking beams 7B is arranged to operate in between each pair of cantilever sections 44, 46 of the locking beam 11.

Although the preceding description contains many specificities, these should not be construed as limiting the scope of the invention, but as merely illustrative of some preferred embodiments. For one example, although the headshell illustrated as one preferred embodiment orients the pin-receiving axes of the terminals in a direction substantially perpendicular to the axis defined by the signal wires leaving the connector headshell, such configuration commonly known as a "right-angle" headshell, an additional configuration orients the pin-receiving contacts on an axis substantially parallel to the signal wires leaving the connector headshell, such configuration commonly being known as a "straight type" or "axial" connector.

In another example, the number of signal lines depicted in the connector and receptacle is two, but other embodiments of any number of signals in any array configuration remain within the scope of this invention.

As another example, the invention is described above as mating with a receptacle having a standardized annular undercut, i.e., a singular undercut which is the current industry standard. The headshell assembly 10 does not have to mate with such a receptacle and is equally useful for a receptacle with a non-annular undercut. For example, there may be intermittent grooves or a set of transverse holes piercing the sidewalls of the receptacle cavity. The latter would be particular useful if a specific orientation of the headshell assembly 10 to the receptacle is sought, and swiveling of the connector relative to the receptacle is not desired.

As yet another example, although the embodiments herein include two fins 16 and two locking beams 11, it is conceivable that more than two fins and/or two locking beams might be provided.

Variations of the embodiments described above and illustrated in the drawings are considered to be within the scope of the invention. Among other variations, different features from one embodiment may be incorporated into any other disclosed embodiment to the extent possible.

Among other variations, while the connector described above is designed to generally mate within the perimeter of a single, generally circular groove containing an annular undercut which affords a latch receiving surface, another embodiment of a connector in accordance with the invention is designed to engage in a single groove of a more arbitrary, non-circular contour or a receptacle offering a plurality of grooves can be engaged by a connector designed in accordance with the invention to offer latches specific to any required number of attachment points on the receptacle side.

In a yet further variation, although the body of the connector headshell 10 is shown in FIG. 2 and elsewhere as an integral unit, and in FIGS. 7 and 8 as a two-component and three-component assembly, respectively, an alternate embodiment may in fact comprise a clam-shell or similar assembly of two, three, or even more than three parts designed to snap together to form a unitary headshell structure.

In yet another embodiment, although the illustrated components forming the headshell such as the housing and the cover of FIG. 7 are heterogeneous and dissimilar pieces, a symmetrical design such as a left-half and right-half housing of a right angle connector, or two axially hermaphroditic shells snappingly assembled to form an integral housing of a straight connector all reside within the scope of this invention.

In still another embodiment, although the illustrated components forming the headshell shown in FIG. 9 show the first cover having at least one alignment strake and the second cover having at least one alignment groove, a complementary arrangement of strakes and grooves such that the first cover has at least one alignment groove and the second cover has at least one alignment strake is also considered to be within the scope of this invention.

In still another embodiment, rather than having two ears 7A in biradial symmetry as shown, slider 7 may include any number of actuation affordances including a single, continuous, generally arcuate form closely contoured to the periphery of the headshell body 10, or more than two ears in a symmetrical or non-symmetrical arrangement.

In yet another embodiment, although the compressive member for storing mechanical energy is most often a helical spring 8, any resilient and sufficiently compressible material may be used instead of compressive spring 8 so as to store and release compressive force used to operate the latch locking function of a complete installation or used to reject the connector assembly from the receptacle in the event of an incomplete installation attempt.

In another embodiment, the housing contains not only the slider 7, compressive member 8, and terminals, but also other electrically effective components such as an RF choke, a filter, or one or more ferrite beads, so as to shunt, absorb or reject unwanted electrical noise or spurious electrical energies absorbed elsewhere within the cable harness but not intended or desired to be transmitted through the connector assembly in accordance with the invention nor admitted to the mission critical unit to which it may be attached. Most often, ferrite beads or electromagnetic chokes are used to prevent spurious electrical noise from deleteriously triggering an airbag to deploy when such action is not deliberately signaled by the vehicle's passenger safety and control systems.

In yet another embodiment, although signal cabling as illustrated depicts a twisted pair of two conductors 30 (see FIGS. 7 and 8, the connector assemblies in accordance with the invention may be configured to be fit for the interconnection of any number of signal lines, and such signal lines may be configured in twisted braids, flat ribbon cable, or a set of loose wires or a set of wires grouped or gathered within a jacket, including a coaxial cable or a shielded coaxial cable. All of these configurations of sets of signal wires are also within the scope of the invention.

Any of the foregoing embodiments, whether illustrated or described, provide advantages for a connector assembly in accordance with the invention in comparison to prior art connectors of a similar type. Among others, one or more embodiments of the connector assembly in accordance with the invention substantially eliminates false confidence in an incomplete interconnection of a cable harness connector headshell to a receiving receptacle. Further, in the case of incomplete mating, since one or more embodiments of the connector assembly in accordance with the invention includes a mechanism that effects a physical rejection of the connector headshell from the receptacle, this serves to uncouple the electrical contacts to terminate electrical interconnection so that a continuity check will fail.

Yet another advantage is that in the case of incomplete mating, since one or more embodiments of the connector assembly in accordance with the invention includes a mechanism that effects a physical rejection of the connector headshell from the receptacle, this provides a visually obvious physical disconnect of the connector headshell from the receptacle or a visually obvious degree of displacement of the headshell from an expected mated position to the receptacle such that correct and complete mechanical and electrical interconnection is not allowed as a reasonable assumption to a user making an interconnect attempt.

Still another advantage is that one or more embodiments of the connector assembly in accordance with the invention facilitate easier assembly of internal components such as the slider, compressive member, terminals and wires leading to the terminals, along with other internal components, by providing a headshell assembly constructed from a plurality of parts such as a housing and a cover.

The connector assembly 10 described above has an optimum connection method to the receptacle to provide for a secure coupling with a self-reject feature. The method involves engaging the connector with the receptacle while ensuring complete and proper connection by moving the housing into the receptacle (from the position shown in FIG. 4), against bias of the spring 8, to cause the blocking beams 7B to abut against the bulkhead surface 2 of the receptacle, then to cause the fins 16 to abut against the blocking beams 7B (the backside ramp thereof) and the locking beams 11 to pass outward of the blocking beams 7B into engagement with the receptacle (see FIG. 5), and then to cause the locking beams 11 to pass into the locking sites of the undercut 4 of the receptacle and cause the fins 16 to urge the blocking beams 7B outward and enable the blocking beams 7B to be positioned inward of the locking beams 11 and prevent release of the locking beams 11 from the locking sites of the undercut 4 of the receptacle (see FIG. 6). Also, the spring 8 between the slider 7 and the housing is configured such that it causes separation of the connector assembly 10 from the receptacle during the movement of the housing until the locking beams 11 are situated in the undercut 4 of the receptacle.

The fins 16 are situated to engage with the backside ramp of the blocking beams 7B during an initial stage of relative movement between the headshell assembly 20 and the slider 7 against a bias of the spring 8 and allow inward deflection of the locking beams 11 (see FIG. 5). The blocking beams 7B are configured to prevent inward deflection of the locking beams 11 after a final stage of the relative movement between the connector assembly 10 and the slider 7 (see FIG. 6), with the advantageous result that the connector has an electrically interconnected state only when in the final stage. Until reaching the final stage, there is no electrical interconnection between the connector assembly 10 and the receptacle.

To aid in this process, the spring 8 may have a specific construction and provided with operational properties. To wit, the spring 8 configured to exert a reaction force while at the initial stage that is at least 5% greater than a reaction force exerted while residing in the final stage. However, in a preferred embodiment, the reaction force residing in the spring 8 in its final position is minimized to a practical limit, and so an embodiment achieving a compressive force at the initial stage substantially higher than the final stage is preferred. An embodiment in which the spring 8 exerts a reaction force in the initial stage that is up to about 500% greater than the reaction force in the final stage is also contemplated, and resides within the scope of our claims.

This effect, of causing the spring 8 to have a slightly or significantly higher reaction force during the initial stage relative to the final stage, enables the spring 8 to play its primary role in separating the headshell assembly 10 from the receptacle in the event of a missed connection or failed connection attempt. At the same time, the lower reaction force of the spring 8 during the final stage, i.e., after relaxation of the spring 8 that occurs once the headshell assembly 10 is properly mated to the receptacle, would not unduly increase stress on the headshell assembly 10. The reaction force of the spring 8 would be sufficient, however, to keep the blocking beams 7B in place after the mating of the headshell assembly 10 and receptacle.

In a manner like a detent, the reaction force accumulating within spring 8 while moving toward the initial stage, followed by the slightly or substantially reduced force during the excursion of the slider to its final stage are both sensed through a user's hand during installation and communicate a two-part tactile signal to the user which viscerally confirms the successful initial operation of the invention. Additionally, the slider is halted at the end of its excursion to the final stage by an abrupt collision with the housing, and this collision emits both an audible signal and a yet further contribution to the total tactile signal (in this regard, see also the description above relating to the mounting of the spring 8 between spring support portion 7C on the slider 7 and the projection 15 on the headshell assembly 10). The combined high-low-slam tactile signal coupled with the audible collision assures the user that correct and complete installation and the desired high-reliability electrical interconnections have been properly and robustly established.

Further examining this operation, the spring support portion 7C of the slider 7 on which one end of the spring 8 is supported, the seat for the opposite end of the spring 8 on an internal surface of the headshell assembly 10, the construction of the slider 7 with the blocking beams 7B, and the general interaction between the slider 7 and the locking beam 11, may be generally considered to constitute spring control means. These spring control means cause a spring to increase its compression force during an initial mating stage of the headshell assembly 10 with a receptacle, reaching a maximum during the initial stage, and then cause a reduction in the compression force after mating of the headshell assembly 10 with the receptacle. Other structure that affects the spring 8 in which manner, which would be apparent to one skilled it he art in view of the disclosure herein, is contemplated to be within the scope of the invention.

For release of the headshell assembly 10 from the receptacle to enable repeated use of the headshell assembly 10, the slider 7 may be configured to enable manual movement of the blocking beams 7B out of their position preventing release of the locking beams 11 from the undercut 4 of the receptacle to thereby enable release of the locking beams 11 from the undercut of the receptacle and removal of the headshell assembly 10 from the receptacle. Upward movement of the slider 7 effected by grasping ears 7A allows release of the locking beams 11 from the undercut 4.

The engaging of the connector assembly 10 with the receptacle may advantageously require only a single act of relative motion of the connector assembly 10 with respect to the receptacle, with all directions of motion of the connector assembly 10 and slider 7 remaining substantially parallel to the mating direction throughout the entirety of the single act of relative motion. This single act may be performed at a substantially uniform velocity or at a non-uniform velocity.

A connector in accordance with the invention may have one or more signal carrying wires attached to it. A most common embodiment employs twisted pair wiring (as shown in FIGS. 7 and 9), but in this industry, and for the purpose of the disclosure herein, coaxial cable is also contemplated wherever twisted pair wiring is implemented, and vice versa, especially since twisted pairs are a technological predecessor of coaxial cabling.

For example, U.S. Pat. No. 6,510,152(A) entitled "Coaxial Cable/Twisted Pair Fed, Integrated Residence Gateway Controlled, Set-Top Box" to Georger and Rutkowski, includes a slash-mark in the title itself which implies that the capability to handle one sort of cable inheres handling the other sort as an obvious variant.

Another example of this fungibility is seen with inventors Brandt and Ploehn who in U.S. Pat. No. 7,121,888(B2) entitled "Multiple Wire Cable Connector," use the phrase "coaxial cables or twisted pairs" liberally throughout their specification.

U.S. Pat. No. 4,169,650(A) entitled "Wire-wrap Assembly Connector" to Schweizer, describes a connector used to terminate signal wire, twisted pair and shielded cables and specifies this to be "universal in application in that it can be used with a single wire, a twisted pair, a shielded twisted pair, or a shielded coaxial cable either individually or simultaneously."

U.S. Pat. No. 7,210,940(B2) entitled "Connector with Inductive Coupling" to Baily and Leyson, describes a connector that receives and electrically manages cable which "may be of coaxial or twisted pair construction."

Therefore, the scope of the twisted pair embodiment of the invention also contemplates and includes the use of coaxial cable.

To this end, additional components are required to handle coaxial cable to the best effect, for example a design in accordance with the invention adapted to coaxial cable may either terminate to a pair of terminals as implied in FIGS. 2, 7, and 9, or it may have a single-pin terminal retained by the housing and electrically connected to the center conductor of the coax cable and have at least one secondary compliant interconnection means electrically connected to the braided or served conductive shield of the coaxial cable, and adapted to make a secondary interconnection at a secondary site. This secondary contact is commonly called a "ground contact."

Figure 10:
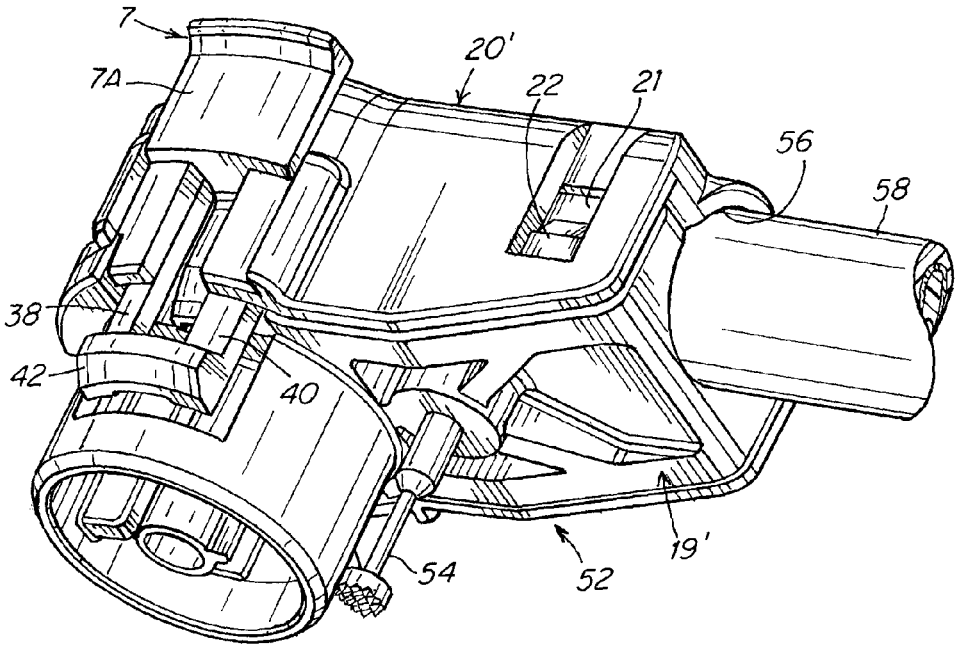
FIG. 10 is a perspective view of a connector configured to mate with a coaxial cable in accordance with the invention.
Figure 11:
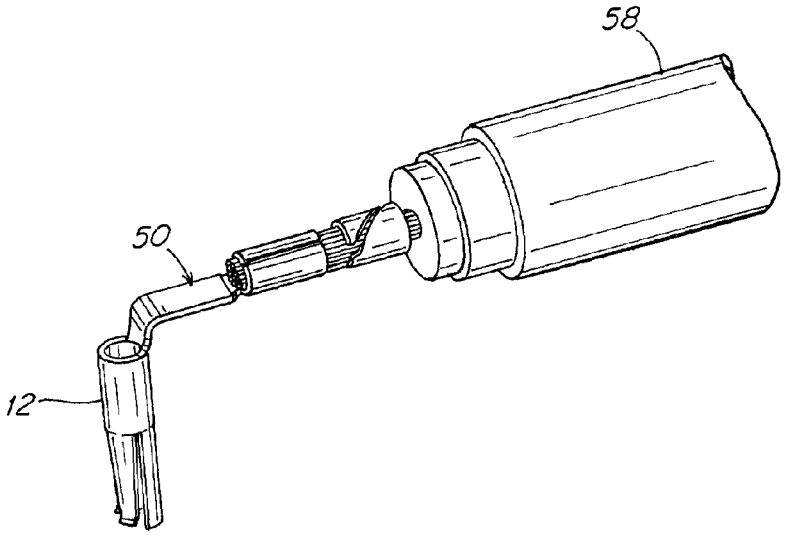
FIG. 11 is a perspective view showing the connection of a coaxial cable to an electrical terminal used in the connector shown in FIG. 10.

In one example shown in FIGS. 10 and 11, a coaxial connector 52 in accordance with the invention includes a housing adapted to receive a commercially available, axially compliant contact or pin often called a "pogo pin" 54 and a typical source of such pins is the Mil-Max company of Oyster Bay, N.Y.

The compliant contact 54 is therefore a ground contact, and in common practice, it is located in the connector housing so that movement in the mating direction allows the ground contact to electrically encounter the receptacle or conductive material of the device holding the receptacle in advance of electrical engagement of the signal terminals. This encounter typically occurs prior to the center conductor of the coaxial cable 58 contacting the central terminal of the coaxial receptacle (not shown).

Unmating of the cable disconnects signal lines prior to disconnecting the ground contact. This method of establishing connection between shielding or grounds between equipment in advance of allowing signal contacts to intermate is well-recognized as useful in industry and has been advertised as "early mate, late break," "EMLB," and "First Mate, Last Break," "FMLB" and other marketing terms. In most respects, the connector 52 has the same or similar components and operation as the connector described above with respect to FIGS. 1-9. A housing 19' and cover 20' of the connector 52 differ from housing 19 and cover 20 in that they define at their rear, a channel 56 that can accommodate the coax cable 58, which is larger in cross-section than a twisted pair of signal carrying cables 30 shown in FIG. 7.

Also, the housing 19' is modified to accommodate the complaint contact 54 (see FIG. 10). The manner in which the housing 19 can be modified is within the purview of one skilled in the art in view of the disclosure herein. The served or braided shield of the coaxial cable 58 communicates electrically with the pogo complaint contact 54.

It is also possible to modify the slider 7 and housing 19' to include only a single locking beam 11, styloid 14, blocking beam 7B and fin 16. Also, while FIG. 10 depicts the ground contact residing outside the effective perimeter of the annular cavity 1 defined by the receptacle, a connector of this invention may position one or any number of ground contacts to operate within said perimeter or within and outside of said perimeter.

Finally, as shown in FIG. 11, the coaxial cable 58 is terminated by the terminal 50 having the female electrical terminal 12. This termination may be in a conventional manner by stripping back the jacket of the coax cable 58 to expose a section of the served or braided shield and then trimmed. The center conductor is then crimped to the terminal 50. The center conductor thus communicates electrically with the terminal 50.

Otherwise, the manner in which the housing 19' cooperates with the slider 7 and spring 8 to provide the operation described above with respect to the cooperation of housing 19 with the slider 7 and spring 8 is essentially the same.

Figure 12:
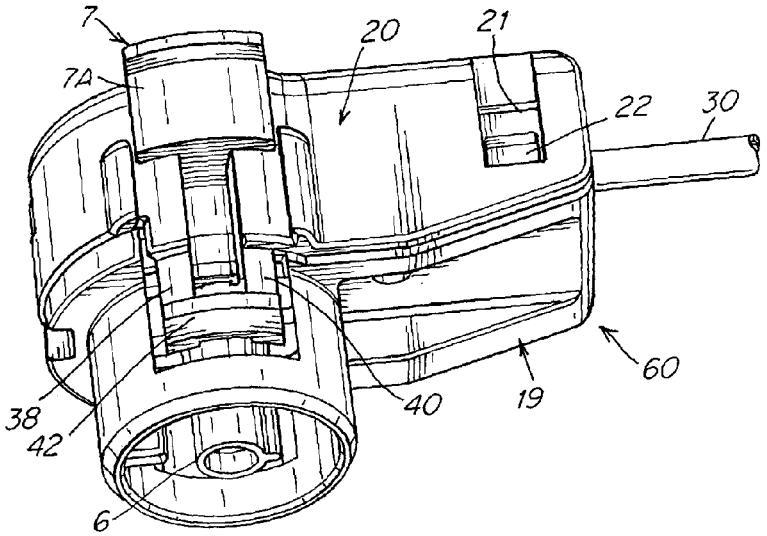
FIG. 12 is a perspective view of a connector configured to mate with a single signal-carrying wire in accordance with the invention.
Figure 13:
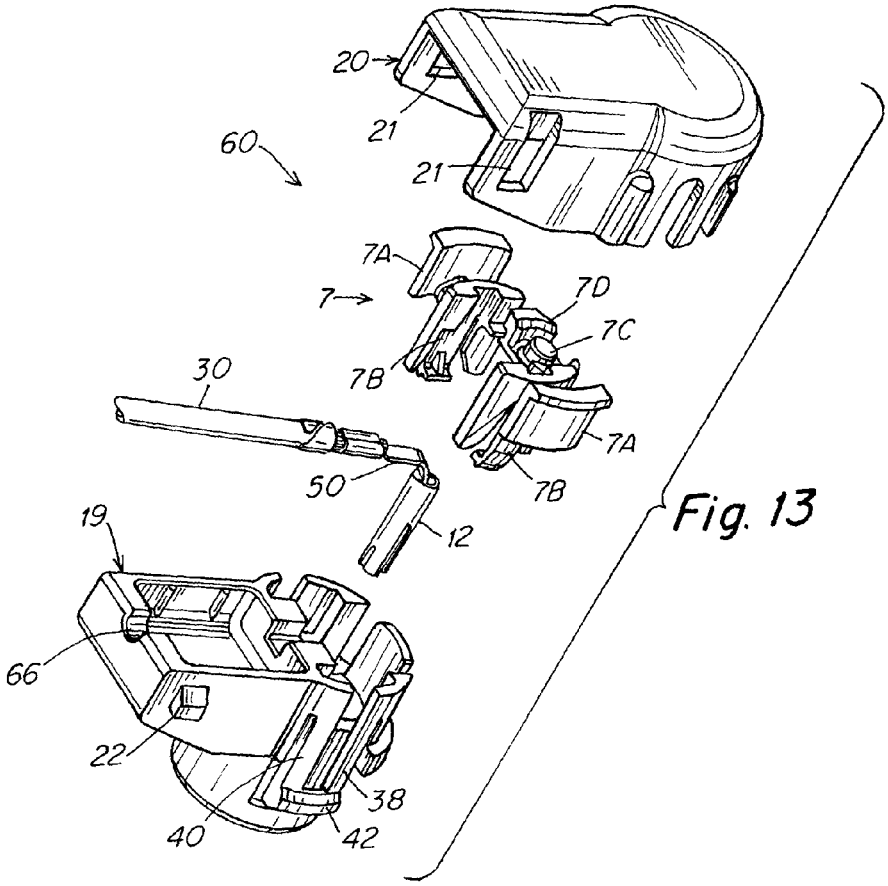
FIG. 13 is an exploded perspective view of the connector shown in FIG. 12.
Figure 14:
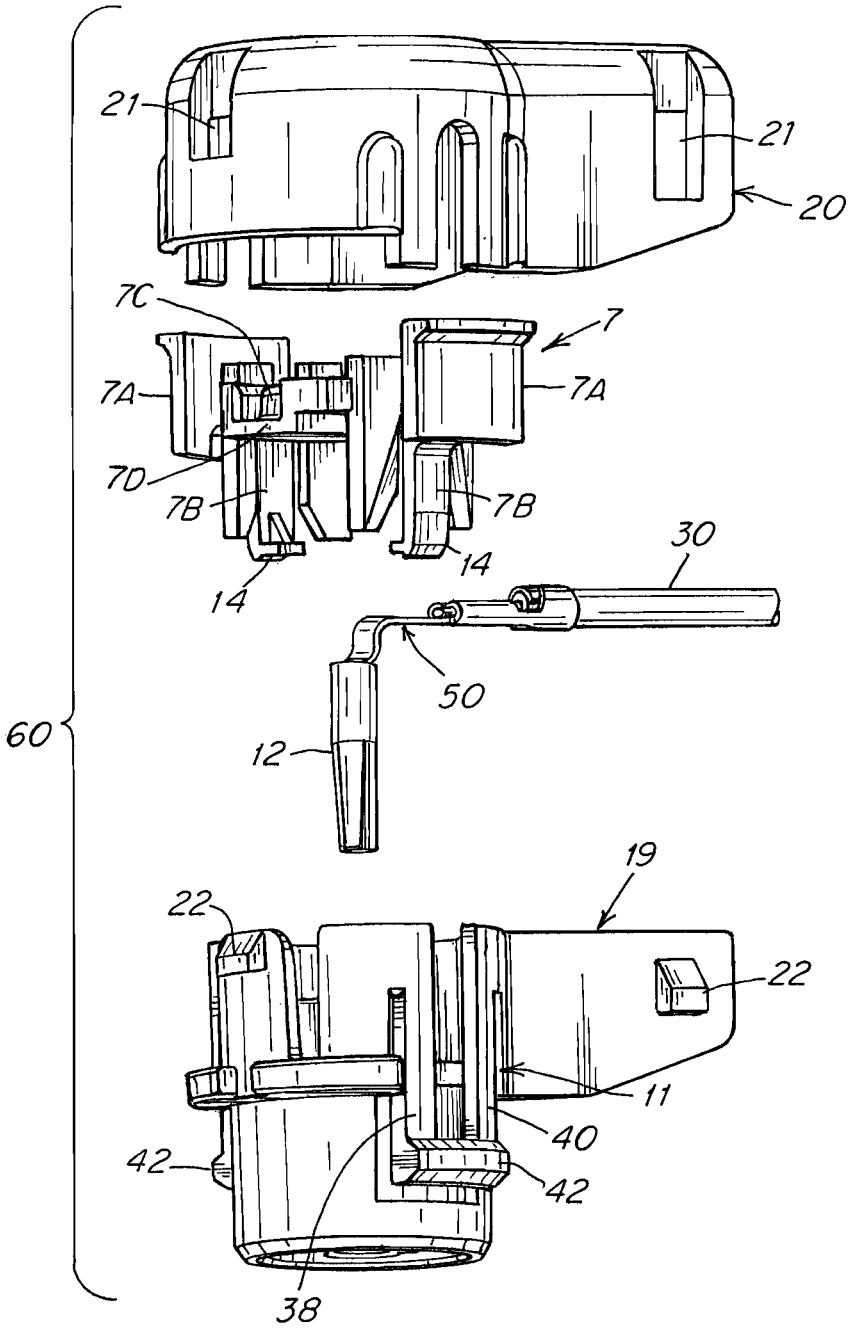
FIG. 14 is an exploded plan view of the connector shown in FIG. 12.

FIGS. 12-14 show an embodiment of a connector 60 including only a single female terminal 50 having a female electrical contact 12. The housing 19 is therefore constructed to accommodate only this single female electrical terminal 50, e.g., there is only a single channel 66 at the rear to allow for passage of a single signal carrying wire into the interior of the connector 60. The slider 7, housing 19 and cover 20 may otherwise have essentially the same construction as in any of the embodiments described above.

As in the coaxial cable connector embodiment described above with respect to FIGS. 10 and 11, the slider 7 and housing 19 may be modified to include only a single locking beam 11, styloid 14, blocking beam 7B and fin 16. Thus, a single-fin, single latching site connector is provided for enabling mating with single signal-carrying wires or cables.

Modifications of the connectors described herein are also contemplated and considered part of the invention. As an example, in the illustrated embodiments, the blocking beams 7B of the slider 7 are situated radially inward of the locking beams 11 and diametrically opposite one another along a center line of the headshell assembly 10. Thus, the distance from the mating axis to the styloid 14 of each blocking beam 7B is less than a distance from the mating axis to the respective locking beam 11 interacting with each blocking beam 7B. However, this diametric opposition is not required and the blocking beams 7B and locking beams 11 may be situated on a centerline offset from the diameter of the headshell assembly 10, yet still maintaining the distance from the mating axis to the styloid 14 of each blocking beam 7B less than the distance from the mating axis to the respective locking beam 11 interacting with each blocking beam 7B. This could reduce the overall diameter of the headshell assembly 10 since the ears 7A of the slider 7 would not project beyond the headshell assembly 10 as much as shown in the illustrated embodiments.

One or more of the embodiments of the invention disclosed above differ from the prior art mentioned in the background of the invention section above.

Indeed, some of the prior art mentioned above, although generally describing electrical connectors with latching means, spring assisted actuations, and locking means to resist disconnection after a successful and correct act of electrical interconnection, does not generally use a compressible member, such as at least one helical spring, in a mode which facilitates rejection of a first plug connector from its complementary receptacle in the event that a complete and correct mating is not achieved. The connectors of some of the prior art mentioned above also do not establish an effective primary latch and secondary lock condition, all with one continuous mating motion, i.e., there does not appear to be any combination of the same set of components in the same arrangement to achieve the same beneficial effects of the inventive connector as disclosed herein.

For example, with respect to the Holweg connector, in this connector, the orientation of the cantilever roots of the locking arms relative to that of the blocking beams is reversed relative to the orientation in one or more embodiments of the invention disclosed above. As such, the kinematics of primary and secondary locking are entirely different.

Moreover, while the Holweg connector includes a functionally similar spring-loaded CPA, its trip mechanism as described appears to depend on Euler buckling of the locking arms once a compressive force sufficient for buckling has accumulated in the beams, whereafter they slide off an obstructing face of the mating receptacle and then the mating motion may proceed. Since the tripping point of a connector in accordance with the Holweg invention is controlled by exceeding some threshold of columnar force, which is itself dependent on a number of variabilities such as the spring constant and production dimensions of a spring or other compression member and also dependent on the material property of the locking arms, all these may affect and perturb the exact buckling point of the beams, and add randomness to the behavior and reliability of this mechanism. Disadvantageously, the tripping point in the Holweg connector is not directly related to an exact and predictable designated relative position of the mating cable connector to its receiving receptacle.

Even further, if plastic or other hygroscopic materials are used as is common within our industry, the rigidity of the locking arms in the Holweg connector in buckling may be at least somewhat dependent on the immediate history of atmospheric humidity experienced by each individual device. For example, if nylon is used for this part, then one device held in storage for weeks at a humid coastal location could trip differently than another device received in an arid, high-elevation location after having been shipped directly from the molding facility which makes these parts.

By contrast, the tripping point of connectors in accordance with the invention is reliably defined by the interaction of fin features on a housing engaging the backside surface of styloids of the slider, so the desired kinematic action occurs at a point of engagement directly related to the relative position of the parts being mated. Factors affecting the trip point of the connector may also be directly determined by extrinsic, accessible, and measurable dimensions, e.g., the mere shapes of interacting parts. Therefore, the trip point is more easily and exactingly controlled because holding profile tolerances in molding is much better understood than maintaining a repeatable uniformity of several material factors such as structural composition in solidification, flow orientation of composite fibers, anisotropic effects, and other intrinsic material properties required when producing the Holweg connector. Connectors in accordance with the invention are therefore expected to provide superior consistency in performance in any environment where installed.

With respect to the Hopf et al. connector that requires two separate motions each in a respective, distinct direction of motion to provide for connector engagement, an embodiment of a connector in accordance with the invention advantageously accomplishes both a primary and a secondary lock by means of a single, convenient, intuitive motion.

Moreover, the second, locking motion of the Hopf et al. connector is allowed even when the first motion, i.e., the full insertion into the mating receptacle, is not properly achieved. In comparison, in one or more embodiments of a connector in accordance with the invention, the headshell self-rejects so that in tandem with creating an electrical disconnect detectable by a continuity check, and when rejecting from an incomplete mate, either falls away completely from the attempt or noticeably stands proud from the expected mating location, and rests instead in a visually detectable displaced position contraindicative of the expected correct and complete mated state. Additionally, one or more embodiments of the invention advantageously emits an audible click and a compelling tactile snap feel when correctly mated, so that the absence of these ergonomic signals will lead reasonably alert and experienced user to question whether the mate attempt was successful and prepare a subsequent attempt if it was not.

Lastly, in the event of an improper mate of one or more embodiments of the invention, the self-rejecting motions advantageously reset all our components into a position immediately ready for the subsequent corrective mating attempt. Deleteriously, the Hopf et al. connector must be manually reset by means of a motion inconveniently perpendicular to the mating axis and mating motion.

With respect to the Gunreben connector, the locking arms of this connector are axially reversed as compared to one or more embodiments of the invention, and the spring arms insert into the "arm pit" at the root of the locking arms from an opposite axial direction. In comparison, the blocking beams of one or more embodiments of the invention slide in behind the cantilevered locking beams while all are oriented in the same insertion direction and all these extend from the headshell.

With this construction, an embodiment of the invention is more axially compact and further, bending stresses during latching are stored in material zones more remote from receptacle surfaces subject to collision shocks during the initial registration phase of a mating attempt. Also, this embodiment of the invention is likely to be less susceptible to damage in this regard than the connector of Gunreben.

With respect to the Inaba et al. connector assembly, one or more embodiments of the invention is tripped differently by means of fins engaging ramps at a predetermined intermediate stage of the mate, and the internal slider is guided exclusively in-line with the mating axis of the inventive connector.

With respect to the connector of McLauchlan et al., one or more embodiments of the invention is adapted to provide a plurality of latch sites along a substantially peripheral contour of a connector and receptacle system and provides individual locking beams and blocking beams designed to act automatically and in concert at a particular and predetermined trip point during a single mating motion.

With respect to the connector of Nakamura (US 2007/0264863(A1)), although this connector includes elements that might be considered similar to those of the disclosed invention, these elements do not cooperate in the same manner as those in the invention and thus cannot provide the advantages obtained by the cooperation of the elements as in the invention. Moreover, the connector does not offer the advantageous secondary blocking effect present in embodiments of the invention which prevents a latched connector from becoming unlatched.

The scope of the invention should be determined by the appended claims and their legal equivalents, rather than by the examples given.

What is claimed is:

1. A receptacle connector for connecting to a plug connector, the receptacle connector comprising:

a housing including a plurality of fins;

at least one electrically conductive terminal at least partly situated in said housing and defining a mating axis and a mating direction;

a plurality of cantilevered locking beams arranged in said housing;

a slider slidingly coupled to said housing and including a plurality of blocking beams extending in the mating direction; and a compressive member arranged to urge said slider outward away from said housing in the mating direction, wherein said fins are situated to engage with said blocking beams during an initial stage of relative movement between said housing and said slider against a bias of said compressive member and allow inward deflection of said locking beams, and wherein said blocking beams are configured to prevent inward deflection of said locking beams after a final stage of the relative movement between said housing and said slider, and the receptacle connector has an electrically interconnected state only when in the final stage.

2. The receptacle connector of claim 1, wherein said at least one terminal is a pin-receiving terminal.

3. The receptacle connector of claim 1, wherein said cantilevered locking beams extend as latches in the mating direction.

4. The receptacle connector of claim 1, wherein said locking beams are sized so as to extend past a bulkhead surface of the plug connector and shaped so as to latchingly engage with a plurality of undercut sites when the receptacle connector is mated with the plug connector.

5. The receptacle connector of claim 1, wherein each blocking beam terminates at a respective end as a styloid having an end face perpendicular to said mating direction, said styloid being radially inward of a respective one of said locking beams, and wherein a distance from the mating axis to the styloid of each of said blocking beams is less than a distance from the mating axis to the respective one of said locking beams interacting with each of said blocking beams.

6. The receptacle connector of claim 5, wherein each of said fins of said housing is configured to engage a respective one of said styloids at the initial stage of relative movement between said housing and said slider.

7. The receptacle connector of claim 5, wherein at least one of said locking beams comprises a pair of spaced apart cantilever sections, said cantilever sections having tips and being bridged at said tips by a unitary latching feature.

8. The receptacle connector of claim 7, wherein at least one of said blocking beams is arranged to operate in between said pair of cantilever sections of said at least one locking beam.

9. The receptacle connector of claim 1, wherein said housing includes at least one protuberance adapted to house said at least one terminal, a respective one of said fins being arranged on an outer surface of said at least one protuberance.

10. The receptacle connector of claim 1, wherein said housing extends radially from the mating axis.

11. The receptacle connector of claim 1, wherein said housing extends axially along said mating axis in a direction opposite that of the mating direction.

12. The receptacle connector of claim 1, wherein said compressive member comprises a helical spring.

13. The receptacle connector of claim 1, wherein said compressive member has a compressive modulus allowing manual actuation such that movement of said slider in a direction along the mating axis clears said blocking beams from interfering with inward deflection of said locking beams.

14. The receptacle connector of claim 1, wherein said compressive member is configured to exert a reaction force while at the initial stage that is at least 5% greater than a reaction force exerted while residing in the final stage.

15. The receptacle connector of claim 1, wherein said compressive member is configured such that during the initial stage of relative movement, said compressive member is sufficiently compressed both to exert an outward force urging said housing away from the plug connector and to maintain a displaced position of said housing distinct from a position of an electrically mated state with the plug connector.

16. The receptacle connector of claim 15, wherein said housing is configured such that in the displaced position of said housing, said housing is visually distinct from a position in which said housing is electrically connected to the plug connector.

17. The receptacle connector of claim 1, wherein said housing comprises:

a body including a latching stub; and a cover including a complementary lumina which snappingly engages onto said stub, said slider, said compressive member and said at least one terminal being housed in an enclosure defined by said body and said cover.

18. The receptacle connector of claim 1, wherein said housing comprises:

a body including a latching stub; and a cover including a complementary latch which snappingly engages onto said stub, said slider, said compressive member and said at least one terminal being housed in an enclosure defined by said body and said cover.

19. The receptacle connector of claim 1, wherein said housing comprises:

a latching stub;

a first cover including a complementary latch which snappingly engages onto said stub, and an alignment strake; and a second cover including an alignment groove complementary to said alignment strake of said first cover, and a latching stub snappingly received within said first cover while said groove of said second cover is slidingly coupled to said strake of said first cover, said slider, said compressive member, and said at least one terminal being housing in an enclosure defined by said first cover and said second cover.

20. The receptacle connector of claim 1, wherein said housing comprises:

a latching stub;

a first cover including a complementary latch which snappingly engages onto said stub, and an alignment groove;

a second cover including an alignment strake complementary to said alignment groove of said first cover, and a latching stub, said stub of said second cover being snappingly received within said first cover while said strake of said second cover is slidingly coupled to said groove of said first cover, said slider, said compressive member, and said at least one terminal being housing in an enclosure defined by said first cover and said second cover.

21. The receptacle connector of claim 1, wherein said at least one electrically conductive terminal consists of a single electrically conductive terminal.

22. The receptacle connector of claim 21, wherein said single electrically conductive terminal is configured to electrically connected to a center conductor of a coaxial cable, further comprising a compliant contact arranged at least partly in said housing and configured to electrically engage with a shield of the coaxial cable.

23. A receptacle connector for connecting to a plug connector, the receptacle connector comprising:

a housing including a fin;

an electrically conductive terminal at least partly situated in said housing and defining a mating axis and a mating direction, said electrically conductive terminal being configured to electrically connect to a conductor of a cable or wire to be terminated by the receptacle connector;

a locking beam arranged in said housing;

a slider slidingly coupled to said housing and including a blocking beam extending in the mating direction; and a compressive member arranged to urge said slider outward away from said housing in the mating direction, and wherein said fin is situated to engage with said blocking beam during an initial stage of relative movement between said housing and said slider against a bias of said compressive member and allow inward deflection of said locking beam, and wherein said blocking beam is configured to prevent inward deflection of said locking beam after a final stage of the relative movement between said housing and said slider, and the receptacle connector has an electrically interconnected state only when in the final stage.

24. A method for securely coupling a receptacle connector to a plug connector, the receptacle connector including a housing having a plurality of fins, at least one electrically conductive terminal at least partly situated in the housing and defining a mating axis and a mating direction, a plurality of cantilevered locking beams arranged in the housing, a slider slidingly coupled to the housing and including a plurality of blocking beams extending in the mating direction, and a compressive member arranged to urge the slider outward away from the housing in the mating direction, and the plug connector including a bulkhead surface, a cavity having latch-receiving undercut sites, and at least one electrical terminal adapted to mate with the at least one terminal of the receptacle connector, the method comprising:

engaging the receptacle connector with the plug connector while ensuring complete and proper connection by moving the housing into the plug connector, against bias of the compressive member, to cause the blocking beams to abut against the bulkhead surface of the plug connector, then to cause the fins to abut against the blocking beams and the locking beams to pass outward of the blocking beams into engagement with the plug connector, and then to cause the locking beams to pass into the undercut sites of the plug connector and cause the fins to urge the blocking beams outward and enable the blocking beams to be positioned inward of the locking beams and prevent release of the locking beams from the undercut sites of the plug connector; and positioning the compressive member between the slider and the housing such that the compressive member causes separation of the receptacle connector from the plug connector during the movement of the housing until the locking beams are situated in the undercut sites of the plug connector.

25. The method of claim 24, further comprising:

configuring each of the plurality of blocking beams with a styloid to thereby provide a plurality of styloids; and configuring each of the fins of the housing to engage a respective one of the styloids and interact with the styloid such that the movement of the housing into the plug connector initially causes the fins to contact the styloids and continued movement of the housing into the plug connector after such contact causes the fins to displace the styloids to move out of contact with the bulkhead surface of the plug connector.

26. The method of claim 24, further comprising configuring the slider to enable manual movement of the blocking beams out of their position preventing release of the locking beams from the undercut sites of the plug connector to thereby enable release of the locking beams from the undercut sites of the plug connector and removal of the receptacle connector from the plug connector.

27. The method of claim 24, further comprising forming the fins on at least one protuberance that houses the at least one terminal of the receptacle connector.

28. The method of claim 24, wherein the step of engaging the receptacle connector with the plug connector comprises performing a single act of relative motion of the receptacle connector with respect to the plug connector, with all directions of motion of the housing and slider remaining substantially parallel to the mating direction throughout the entirety of the single act of relative motion.

29. A method for securely coupling a receptacle connector to a plug connector, the receptacle connector including a housing having a plurality of fins, at least one electrically conductive terminal at least partly situated in the housing and defining a mating axis and a mating direction, a plurality of cantilevered locking beams arranged in the housing, and a slider slidingly coupled to the housing and including a plurality of blocking beams extending in the mating direction, and the plug connector including a bulkhead surface, a cavity having latch-receiving undercut sites, and at least one electrical terminal adapted to mate with the at least one terminal of the receptacle connector, the method comprising:

moving the housing into the plug connector in a single act of relative motion of the housing into the plug connector, with all directions of motion of the housing and slider remaining substantially parallel to the mating direction throughout the entirety of the single act of relative motion, to cause the blocking beams to abut against the bulkhead surface of the plug connector, then to cause the fins to abut against the blocking beams and the locking beams to pass outward of the blocking beams into engagement with the plug connector, and then to cause the locking beams to pass into the undercut sites of the plug connector and cause the fins to urge the blocking beams outward and enable the blocking beams to be positioned inward of the locking beams and prevent release of the locking beams from the undercut sites of the plug connector; and preventing the receptacle connector from mating with the plug connector during the single act of relative motion until the locking beams are situated in the undercut sites of the plug connector.

30. The method of claim 29, wherein the step of preventing the receptacle connector from mating with the plug connector during the single act of relative motion until the locking beams are situated in the undercut sites of the plug connector comprises:

positioning a compressive member, having a bias against which the housing acts when moved into the plug connector, between the slider and the housing; and configuring the compressive member to urge the slider outward away from the housing in the mating direction and cause separation of the housing from the plug connector until the locking beams are situated in the undercut sites of the plug connector.

* * * * *